United States Patent [19]

Wasson

[11] Patent Number: 4,830,637

[45] Date of Patent: May 16, 1989

[54] PREAGGLOMERATION OF FINE COAL BEFORE THERMAL DRYER IN A PREPARATION PLANT

[75] Inventor: George E. Wasson, Eighty Four, Pa.

[73] Assignee: Consolidation Coal Company, Pittsburgh, Pa.

[21] Appl. No.: 173,850

[22] Filed: Mar. 28, 1988

[51] Int. Cl.[4] ..... C10L 5/00

[52] U.S. Cl. ..... 44/550; 44/620; 44/629

[58] Field of Search ..... 44/629, 503, 601, 602, 44/550, 620

[56] References Cited

U.S. PATENT DOCUMENTS 1,988,999 1/1935 Cunningham et al. ..... 44/602
2,973,254 2/1961 Schmidt ..... 44/601

FOREIGN PATENT DOCUMENTS 1051639 12/1966 United Kingdom ..... 44/629

*Primary Examiner*—Carl F. Dees
*Attorney, Agent, or Firm*—Alan N. McCartney

[57] ABSTRACT

Method and apparatus for reducing the dustiness and increasing the size distribution of a coal product in a coal preparation plant by mixing dewatered coal fines and recycled fine coal from the cyclone separator with a binder to form an agglomerated/size enlarged coated product which can be passed through a thermal dryer.

1 Claim, 1 Drawing Sheet

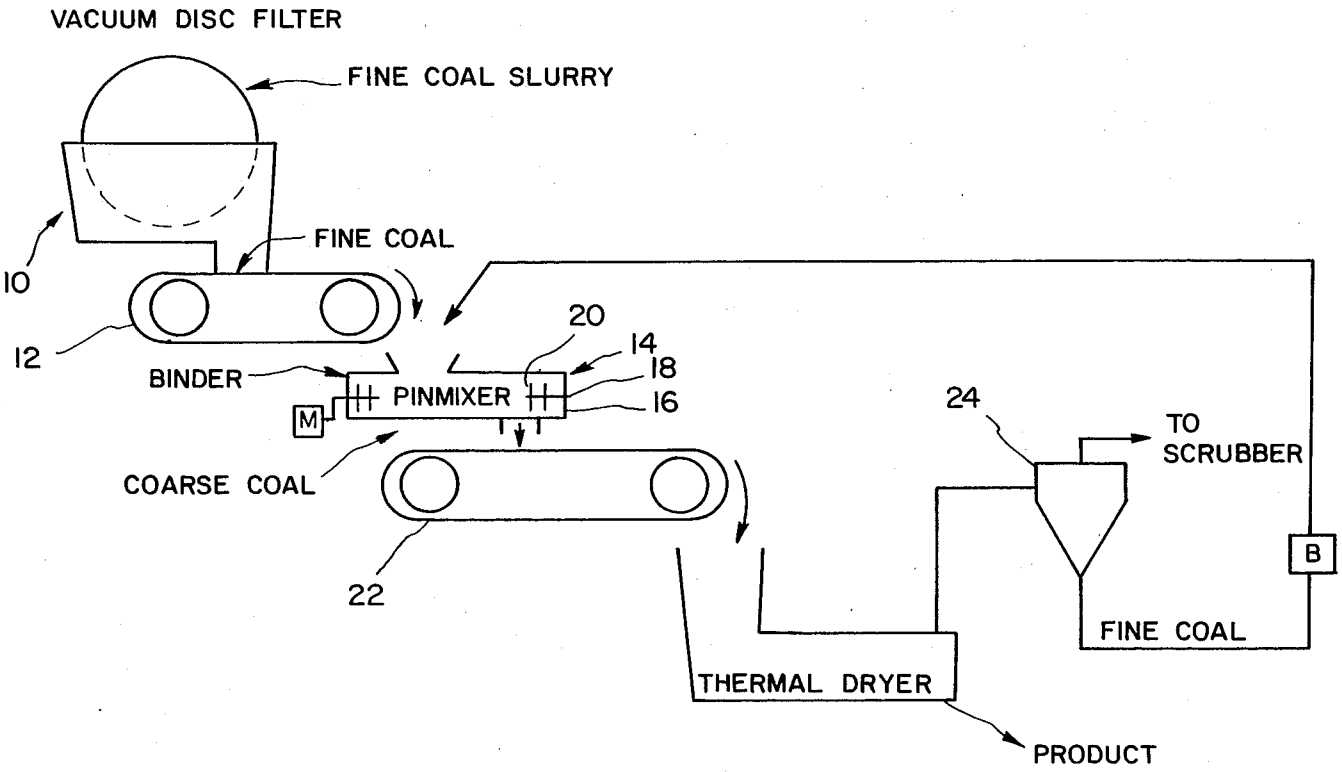
VACUUM DISC FILTER
FINE COAL SLURRY
FINE COAL
BINDER
PINMIXER
M
COARSE COAL
20
14
18
16
24
TO SCRUBBER
B
FINE COAL
THERMAL DRYER
PRODUCT
10
12
22

PREAGGLOMERATION OF FINE COAL BEFORE THERMAL DRYER IN A PREPARATION PLANT

BACKGROUND OF THE INVENTION

1. Field of the Invention

Preparation plant fine coal from the vacuum disc filter is agglomerated together with cyclone recycle fines and a binder in a pinmixer to produce +28 mesh particles. The agglomeration is before the thermal dryer.

2. SUMMARY OF THE PRIOR ART

It is well-known in many arts to agglomerate materials by mixing the material fines with a binder to cause the fines to adhere to produce particle growth. For example, U.S. Pat. No. 3,651,179 discloses passing wet raw poorly fusing petroleum coke through a drye and crusher and then adding a binder in a mixer before pelletizing. U.S. Pat. No. 3,830,943 discloses a method for agglomerating dry food particles in a drum and U.S. Pat. No. discloses an apparatus for making granular superphosphate.

SUMMARY OF THE INVENTION

It is an object of this invention to increase the size distribution of a coal preparation plant product by placing dewatered coal fines in an agglomerating device with cyclone recycle fines before passing to a thermal dryer.

It is also an object of this invention to mix preparation plant fine coal from the vacuum disc filter with cyclone recycled coal fines in a pinmixer prior to passing through a thermal dryer. A binder can be added to the pinmixer. This will reduce the dustiness of the product and reduce or elminate the water and other chemical sprays required on the coal product to reduce dustiness and freezing.

BRIEF DESCRIPTION OF THE DRAWING

The single figure of the drawing is a schmmatic illustration of the process of this invention, diagramically illustrating the apparatus involved.

DESCRIPTION OF THE PREFERRED EMBODIMENT

Coal is agglomerated during coal processing in a preparation plant. Coal can be agglomerated by compaction or agitation. Briquetters, extruders and pellet mills are types of compaction equipment. Agitation agglomeration methods include pinmixers, disc pelletizers, drum pelletizers and liquid phase agglomeration using high shear mixing.

Most forms of coal agglomeration methods use either an organic binder such as lignosulfonate, petroleum pitch, latex or polymers or an inorganic binder such as cement or bentonite. Binder choice depends principally on the cost of the binder and the product quality required.

In the conventional coal processing plant, the coal fines are recovered by passing a coal slurry through a dewatering device such as a vacuum disc filter and then to a thermal dryer before mixing with the coarse coal. Water and other dust preventative additives and binders are added after the thermal dryer. The fines blown out of the dryer and collected in the cyclone are presently mixed with the coarse coal product. In current practice, during the winter months, antifreeze agents also have to be added to the coal product to prevent freezing.

With this background, it is the purpose of this invention to place the dewatered coal fines from the vacuum disc filter and recycled fines from the thermal dryer cyclone underflow into a pinmixer and add a binder to produce +28 mesh agglomerates. This product is then passed through the thermal dryer with, again, the coal fines from the thermal dryer cyclone underflow are recycled to the pinmixer for further processing.

With this type of apparatus and process, all the fine coal in the prep plant is treated with binder, agglomerated into +28 mesh particles and heated and dried in the thermal dryer. With the recycling of the fines from the cyclone underflow, these fines are not mixed with the other plant product in the conventional manner to create dust, but are reprocessed into +28 mesh agglomerates. Since all fines are exposed to a binder, there would be no water sprayed on the product after the thermal dryer, as in the conventional practice. Further, the product from the thermal dryer would be less prone to freeze because of its coarser size and lower moisture content (no water added as a dust suppressant after the thermal dryer). Preagglomeration/size enlargement before the thermal dryer can increase the amount of coal cleaned, while still using the thermal dryer and produce a non-dusty product.

Attention is now directed to the drawing which schematically illustrates the flow of the prep plant process with the various processing apparatus being diagramically illustrated. A coal fine slurry is dewatered in a conventional vacuum disc filter 10 and deposited on a transporter 12 and into a pinmixer 14. The pinmixer is a horizontal cylindrical casing 16 enclosing a shaft 18 driven by a motor "M" and containing several rods, pins or paddles 20 extending outwardly to a short distance from the inside surface of the casing 16.

The fines from the underflow of the cyclone are added to the pinmixer along with a binder and the agitation of the fines in the mixer will cause particulate growth. (A pneumatic transporter such as blower "B" in the line from the cyclone to the pinmixer will transport these fines). The agglomerated product passes out of the pinmixer onto a transporter 22 and into the thermal dryer where the pelletized product is dried and thereafter directed out of the dryer. The moisture laden gas with unprocessed fines pass through the cyclone 24 which further separates the fines from the flue gas, which is passed to a scrubber for removal of toxic gases and fine particles before release from the prep plant to the atmosphere. The fines from the cyclone underflow are recycled to the pinmixer to be preagglomerated with the dewatered fine coal from the vacuum disc filter.

It can thus be seen that with the method and apparatus of this invention, all the fine coal from the preparation plant can be agglomerated and dried producing a dust-free product. As illustrated in the drawing, the coarse coal can also be added to the agglomerated fines at the transporter 22 for passage through the thermal dryer to minimize the moisture content of the combined product.

I claim:

1. The method of fine coal recovery in a coal processing plant to minimize dustiness and amount of additives required for coal handling comprising the steps of:

(a) combining dewatered coal fines from the vacuum disc filter with recycled unprocessed fine coal from a thermal dryer cyclone;

(b) agglomerating the coal fines and fine coal with a binder in a pinmixer;

(c) gas drying the agglomerates to a predesired moisture content in a thermal dryer;

(d) separating unprocessed fine coal from the drying gas in a thermal dryer cyclone; and (e) recycling the unprocessed fine coal for mixture with the coal fines in the pinmixer.

* * * * *